US009835323B1

(12) United States Patent
Rubinstein

(10) Patent No.: US 9,835,323 B1
(45) **Date of Patent: *Dec. 5, 2017**

(54) DEVICE AND METHOD FOR AN ILLUMINATED BALLOON

(71) Applicant: David Brett Rubinstein, Boca Raton, FL (US)

(72) Inventor: David Brett Rubinstein, Boca Raton, FL (US)

( * ) Notice: Subject to any disclaimer, the term of this patent is extended or adjusted under 35 U.S.C. 154(b) by 148 days.

This patent is subject to a terminal disclaimer.

(21) Appl. No.: 15/047,008

(22) Filed: Feb. 18, 2016

Related U.S. Application Data

(63) Continuation of application No. 14/150,898, filed on Jan. 9, 2014, now Pat. No. 9,303,862.

(60) Provisional application No. 61/753,546, filed on Jan. 17, 2013.

(51) Int. Cl.

| | |
|---|---|
| ***F21V 1/06*** | (2006.01) |
| ***F21V 33/00*** | (2006.01) |
| ***A63H 27/10*** | (2006.01) |
| ***F21V 23/06*** | (2006.01) |
| ***F21V 19/00*** | (2006.01) |
| *F21W 121/00* | (2006.01) |
| *F21Y 101/02* | (2006.01) |

(52) U.S. Cl.
CPC ..... *F21V 33/0004* (2013.01); *A63H 27/10* (2013.01); *F21V 19/0015* (2013.01); *F21V 23/06* (2013.01); *A63H 2027/1058* (2013.01); *F21W 2121/00* (2013.01); *F21Y 2101/02* (2013.01)

(58) Field of Classification Search
CPC ..... F21V 3/023; F21V 33/00; F21W 2121/00; F21W 1113/13; A63H 33/32; A63H 3/00; A63H 11/00
See application file for complete search history.

(56) References Cited

U.S. PATENT DOCUMENTS

| | | | | |
|---|---|---|---|---|
| 5,795,211 | A * | 8/1998 | Carignan | A63H 27/10 362/253 |
| 5,947,581 | A * | 9/1999 | Schrimmer | A63H 27/10 362/189 |
| 7,478,779 | B2 * | 1/2009 | Nguyen | F21V 3/023 244/24 |
| 8,297,778 | B2 * | 10/2012 | Jeffrey | A63H 27/10 362/186 |
| 9,303,862 | B1 * | 4/2016 | Rubinstein | A63H 33/22 |
| 2006/0039138 | A1 * | 2/2006 | Oxborrow | A63H 27/10 362/189 |
| 2009/0067154 | A1 * | 3/2009 | Carito | A63H 27/10 362/96 |

(Continued)

*Primary Examiner* — Ali Alavi
(74) *Attorney, Agent, or Firm* — Ted Masters

(57) ABSTRACT

A device for an illuminated balloon includes a light emitting diode. A holder is connected to the light emitting diode, the holder having a first side, an opposite second side, and a hole which receives the light emitting diode, the hole extending from the first side to the second side. The holder is connectable to the inside surface of the balloon, so that the light emitting diode points out from the balloon. When so connected to the balloon, the longitudinal axis of the light emitting diode is oriented substantially perpendicular to the surface of the balloon. In an embodiment the holder is disc shaped, is fabricated from foam, and is connected to the inside surface of the balloon by an adhesive.

19 Claims, 11 Drawing Sheets

(56) References Cited

U.S. PATENT DOCUMENTS

2009/0296372 A1* 12/2009 Schrimmer ..... A63H 27/10
362/96

* cited by examiner

Fig. 4
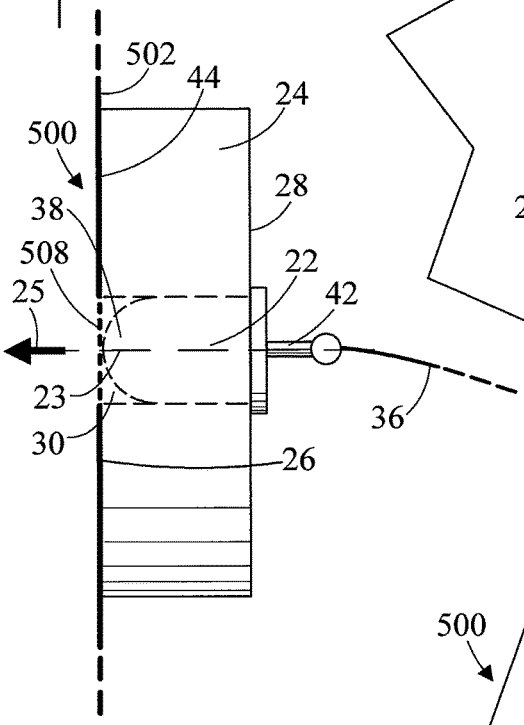
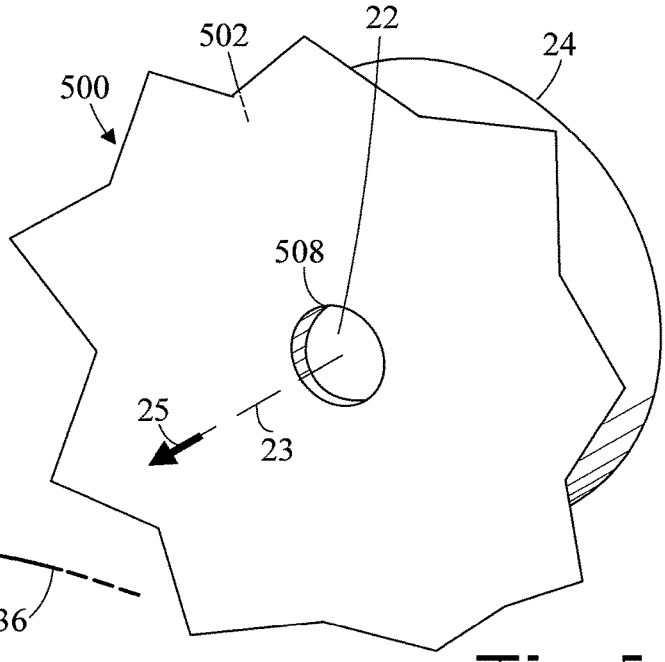
Fig. 5
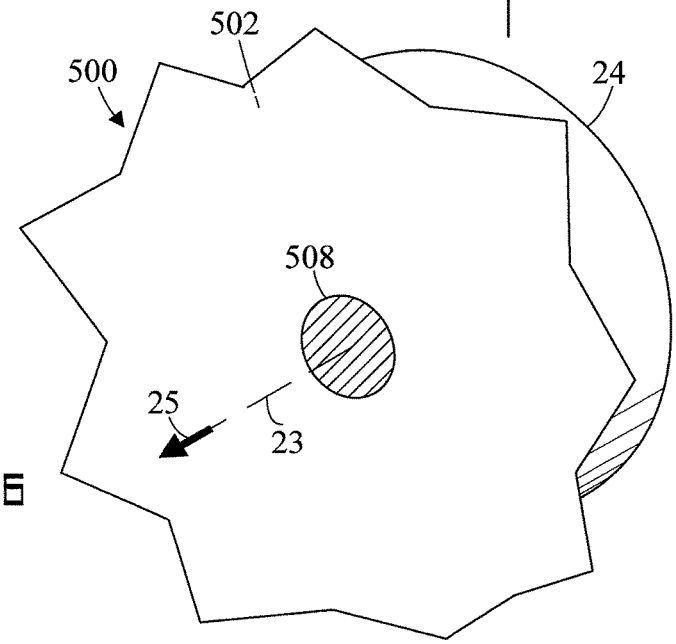
Fig. 6

Fig. 7
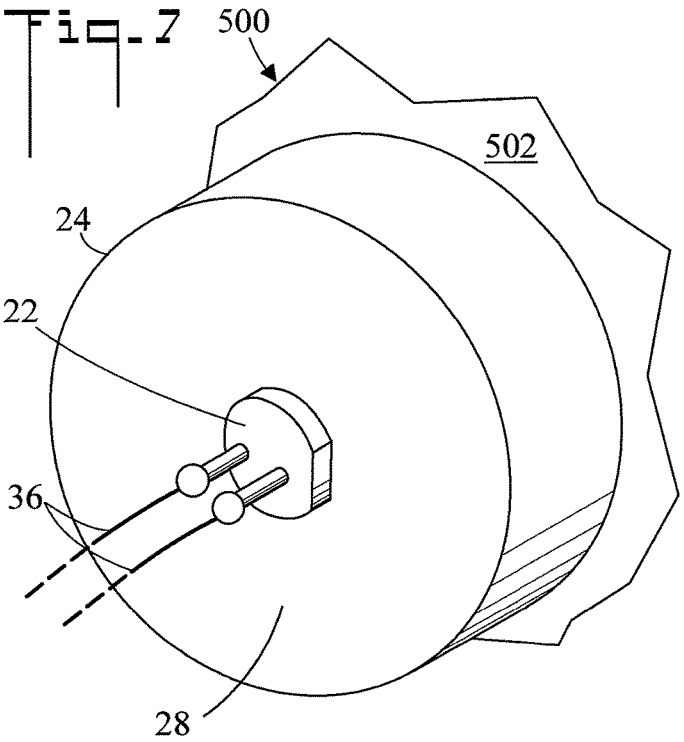
Fig. 8
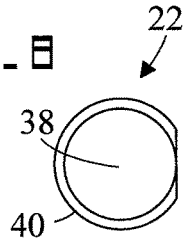
Fig. 9
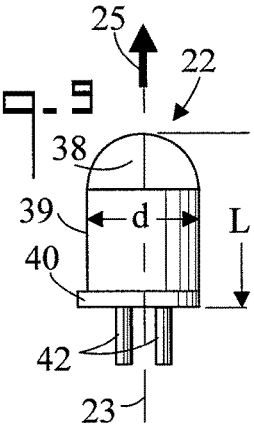
Fig. 10
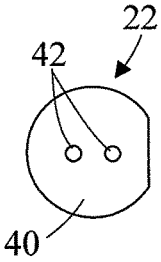
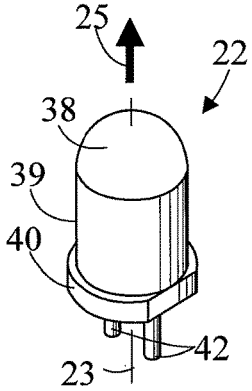
Fig. 11
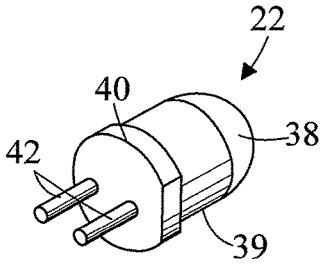
Fig. 12

DEVICE AND METHOD FOR AN ILLUMINATED BALLOON

CROSS REFERENCE TO RELATED APPLICATION

This application is a continuation of and claims the filing benefit under 35 U.S.C. §120 of U.S. application Ser. No. 14/150,898, filed Jan. 9, 2014, which is hereby incorporated by reference. This application also claims the filing benefit under 35 U.S.C. §119(e) of U.S. Provisional Application No. 61/753,546, filed Jan. 17, 2013, which is hereby incorporated by reference.

TECHNICAL FIELD

The present invention generally pertains to balloons, and more particularly to a device and method for an illuminated balloon.

BACKGROUND OF THE INVENTION

Balloons are traditional decorations which can be used for all types of occasions. They are relatively cheap and can feature any number of designs, logos, etc., both of which features have helped in their popularity. One downfall of balloons, however, is their lack of visibility at night. As a result attempts have been made to create illuminated balloons using light emitting diodes which can be seen both during the day and at night. Many of these illuminated balloons feature external power sources, require special ties to close or include otherwise inconvenient features for the users. Additionally, many illuminated balloons fail to emit a sufficient amount of light.

BRIEF SUMMARY OF THE INVENTION

The present invention is directed to a device and method for an illuminated balloon. Because of its orientation, the device allows the illumination of light emitting diodes to be seen both during the day and at night. The superior illumination is the result of holders which connect to the inside surface of the balloon, receive the light emitting diode, and direct the light directly out from the surface of the balloon.

In accordance with an embodiment, a device for an illuminated balloon having an inside surface and a center includes a light emitting diode having a lens. A holder is connected to the light emitting diode, the holder having a first side, an opposite second side, and a hole which receives the light emitting diode, the hole extending from the first side to the second side. The first side of the holder is connectable to the inside surface of the balloon so that the lens directs light outwardly through the inside surface of the balloon and away from the center of the balloon.

In accordance with another embodiment, the light emitting diode has an electrical terminal which is disposed closer to the center of the balloon than is the lens.

In accordance with another embodiment, the light emitting diode has a longitudinal axis, which is substantially perpendicular to the first side.

In accordance with another embodiment, when the holder is connected to the inside surface of the balloon, the longitudinal axis is substantially perpendicular to the inside surface of the balloon.

In accordance with another embodiment, the balloon has a window. The holder is connectable to the inside surface of the balloon so that the light emitting diode is aligned with the window.

In accordance with another embodiment, the holder is disc shaped wherein the first side is parallel to the second side with a circular edge disposed therebetween.

In accordance with another embodiment, the holder is fabricated from foam.

In accordance with another embodiment, an adhesive connects the first side of the holder to the inside surface of the balloon.

In accordance with another embodiment, a plurality of light emitting diode and holder pairs are each connected to the inside surface of the balloon. The plurality of light emitting diodes each being connected to a light emitting diode sequencer circuit.

In accordance with another embodiment, the light emitting diode has a tip. The tip of the light emitting diode not outwardly extending beyond the first side of the holder.

In accordance with another embodiment, the light emitting diode has a flange having a width W. The hole in the holder has a diameter HD, wherein HD is less than W In accordance with another embodiment, the light emitting diode has a flange. The second side of the holder has a recess which is shaped and dimensioned to closely receive the flange of the light emitting diode.

Other embodiments, in addition to the embodiments enumerated above, will become apparent from the following detailed description, taken in conjunction with the accompanying drawings, which illustrate, by way of example, the principles of the device and method for an illuminated a balloon.

BRIEF DESCRIPTION OF THE DRAWINGS

FIG. 4 is a view of area 4 of FIG. 3;

FIG. 5 is a fragmented front perspective view of a light emitting diode and holder connected to the balloon, the balloon having a clear window;

FIG. 6 is a fragmented front perspective view of the light emitting diode and holder connected to the balloon, the balloon having a semi-transparent window;

FIG. 7 is a fragmented rear perspective view of the light emitting diode and holder connected to the balloon;

FIG. 8 is a top plan view of a light emitting diode;

FIG. 9 is a side elevation view of the light emitting diode;

FIG. 10 is a bottom plan view of the light emitting diode;

FIG. 11 is a perspective view of the light emitting diode;

FIG. 12 is rotated perspective view of the light emitting diode;

DETAILED DESCRIPTION OF THE INVENTION

Figure 1:
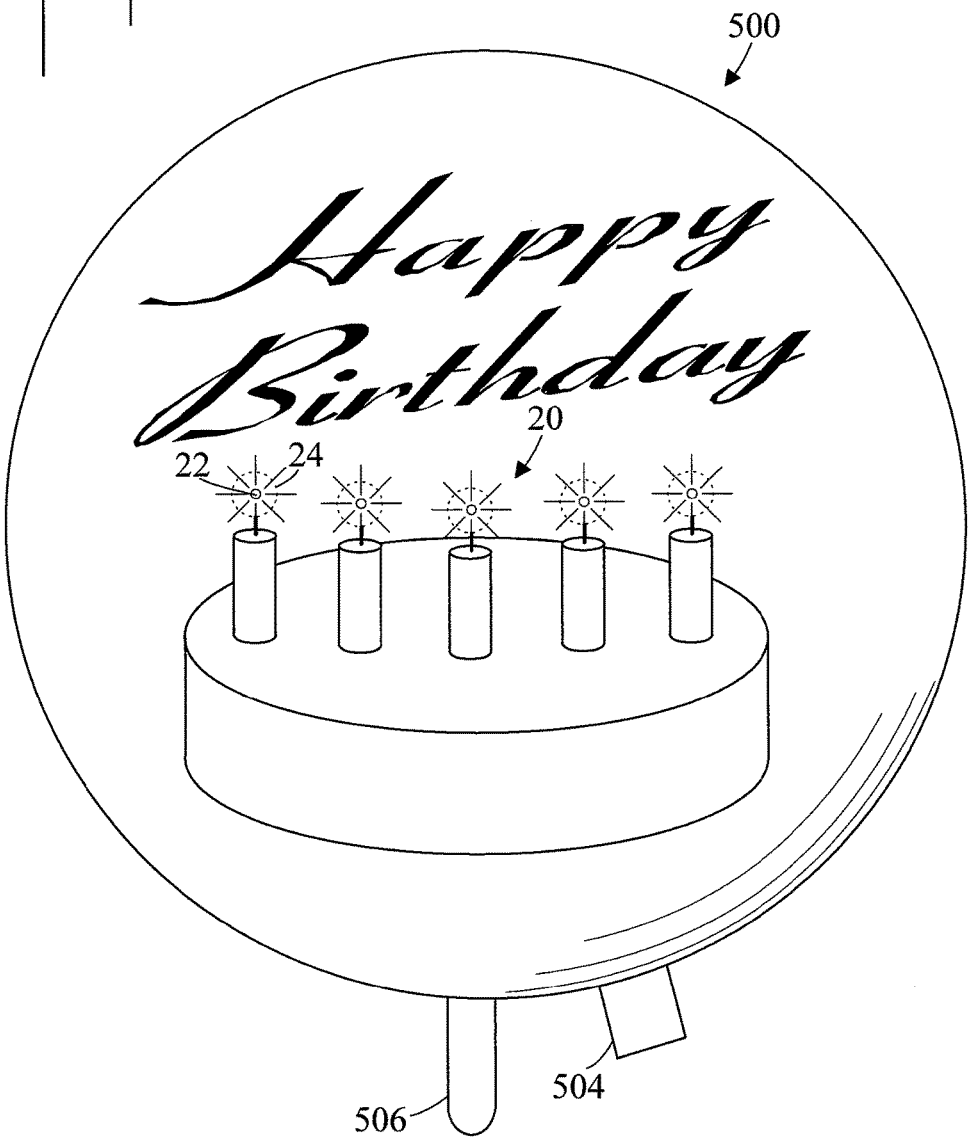
FIG. 1 is a reduced front elevation view of an illuminated balloon with a device connected thereto.
Figure 2:
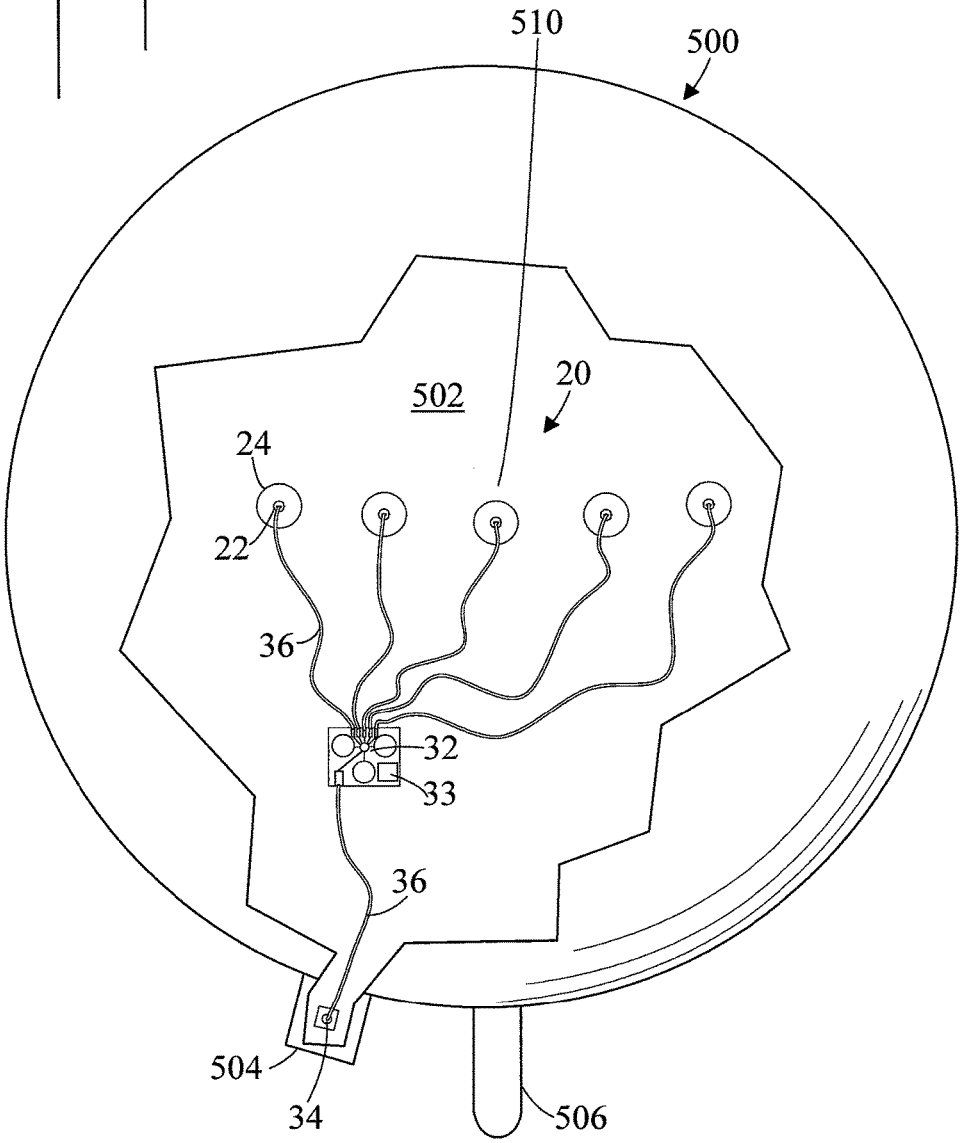
FIG. 2 is a reduced cutaway rear elevation view of the device and the balloon.
Figure 3:
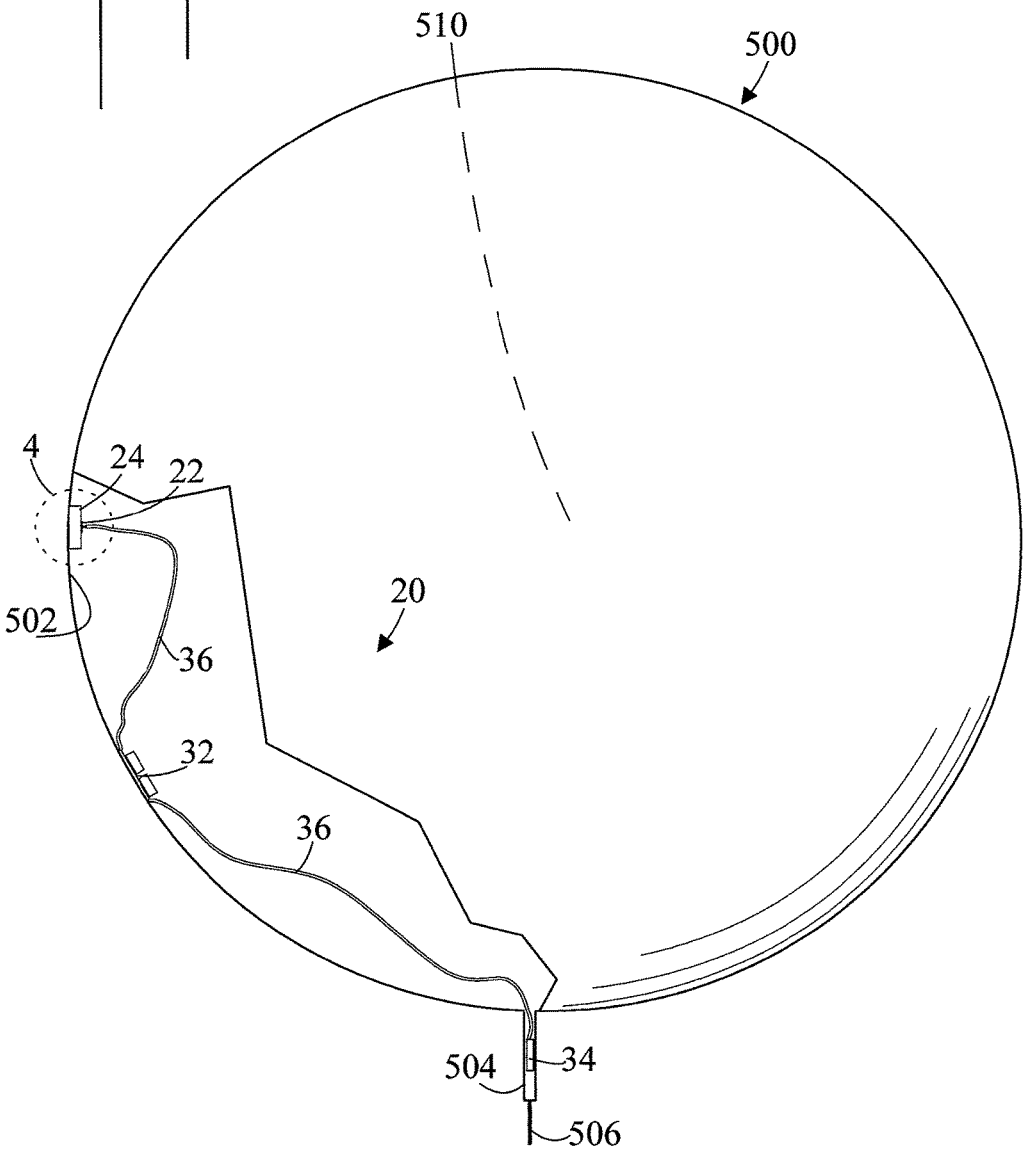
FIG. 3 is a reduced cutaway side elevation view of the device and the balloon.

Referring initially to FIGS. 1-3, there are illustrated reduced front elevation, reduced cutaway rear elevation, and reduced cutaway side elevations views respectively of an illuminated balloon 500 with a device connected thereto, the device generally designated as 20. As shown, balloon 500 is inflated and has an inside surface 502. Device 20 includes a light emitting diode 22 (also refer to FIGS. 8-12). Also referring to FIGS. 13-17, device 20 further includes a holder 24 which is connected to light emitting diode 22, holder 24 has a first side 26, an opposite second side 28, and a hole 30 which receives light emitting diode 22, hole 30 extends from first side 26 to second side 28. The first side 26 of holder 24 is connectable to inside surface 502 of balloon 500 (also refer to FIG. 4 and the associated discussion). In the shown embodiment, a plurality of light emitting diode 22 and holder 24 pairs (five as shown) are each connected to the inside surface 502 of balloon 500.

In the shown embodiment, the plurality of light emitting diodes 22 are each connected to a light emitting diode sequencer circuit 32 which causes the light emitting diodes 22 to illuminate in a pre-determined sequence. Light emitting diode sequencer circuit 32 can be connected to the inside surface of balloon 500 by an adhesive, and can be programmable so that a variety of light sequences may be presented. Light emitting diode sequencer circuit 32 is energized by a switch 34 which is disposed in a pocket 504 which outwardly projects from balloon 500. Sequencer circuits are well know in the light emitting diode art. Wires 36 connect light emitting diode 22 to light emitting diode sequencer circuit 32, and also connect switch 34 to light emitting diode sequencer circuit 32. A battery 33 powers sequencer circuit 32 and light emitting diodes 22. Balloon 500 also includes a valve 506 for effecting inflation with a gas such as helium as is well known in the art. Balloon 500 can be fabricated from Mylar or other suitable material, and can include indicia (e.g. Happy Birthday). The various components of device 20 are selected to be light weight so that they will not prevent balloon 500 from floating when filled with a lighter than air gas. Balloon 500 has a center 510 (middle part)

FIG. 4 is a view of area 4 of FIG. 3, showing the connection of holder 24 to the inside surface 502 of balloon 500. Light emitting diode 22 has a longitudinal axis 23 which is substantially perpendicular to first side 26 of holder 24. As such, when first side 26 of holder 24 is connected to inside surface 502 of balloon 500, the longitudinal axis 23 of light emitting diode 22 is also substantially perpendicular to inside surface 502 of balloon 500 so that the light 25 emitted from light emitting diode 22 shines out substantially perpendicularly from the surface of balloon 500. This perpendicular orientation makes light emitting diode 22 more visible. It is noted that holder 24 is only perpendicular to the inside surface 502 of balloon 500 at the point of attachment, and not to other portions of inside surface 502 (due to the curved surface of balloon 500). The connection of holder 24 to the inside surface 502 of balloon 500 can be effected by an adhesive or other suitable means (also refer to FIG. 13). In the shown embodiment, balloon 500 has a window 508 (shown as a dashed line in FIG. 4) which is one of clear (transparent) and semi-transparent (translucent). Holder 24 is connectable to the inside surface 502 of balloon 500 so that light emitting diode 22 is aligned with window 508. That is, holder 24 is connected so that the light 25 from light emitting diode 22 shines out from window 508 (also refer to FIGS. 5 and 6). An adhesive 44 connects first side 26 of holder 24 to inside surface 502 of balloon 500. Also referring to FIG. 3, it is noted that first side 26 of holder 24 is connectable to inside surface 502 of balloon 500 so that lens 38 directs light 25 outwardly through inside surface 502 of balloon 500 and away from the center 510 of balloon 500. It is also noted that light emitting diode 22 has an electrical terminal 42, and that electrical terminal 42 is disposed closer to the center 510 of balloon 500 than is lens 38.

FIG. 5 is a fragmented front perspective view of light emitting diode 22 and holder 24 connected to a balloon 500 which has a clear window 508, and FIG. 6 is a fragmented front perspective view of light emitting diode 22 and holder 24 connected to a balloon 500 which has a semi-transparent window 508 (shown hashed). It is noted that in the embodiments of both FIGS. 5 and 6, windows 508 are surrounded by an opaque surface of balloon 500. In FIG. 5 light 25 from light emitting diode 22 freely passes through clear window 508, and in FIG. 6 light 25 from light emitting diode 22 passes through semi-transparent window but is diffused.

FIG. 7 is a fragmented rear perspective view of second side 28 of holder 24 and light emitting diode 22 with holder 24 connected to the inside surface 502 of balloon 500. Wires 36 connect light emitting diode 22 to light emitting diode sequencer circuit 32 (refer to FIGS. 1-3).

FIG. 8-12 are top plan, side elevation, bottom plan, perspective, and rotated perspective views respectively light emitting diode 22. Light emitting diode 22 includes a longitudinal axis 23, a lens 38 which focuses light 25 along longitudinal axis 23, a body 39, a mounting flange 40, and two electrical terminals 42. Body 39 has a diameter d. In the shown embodiment, light emitting diode 22 has a length L of about 5/32 of an inch.

Figure 13:
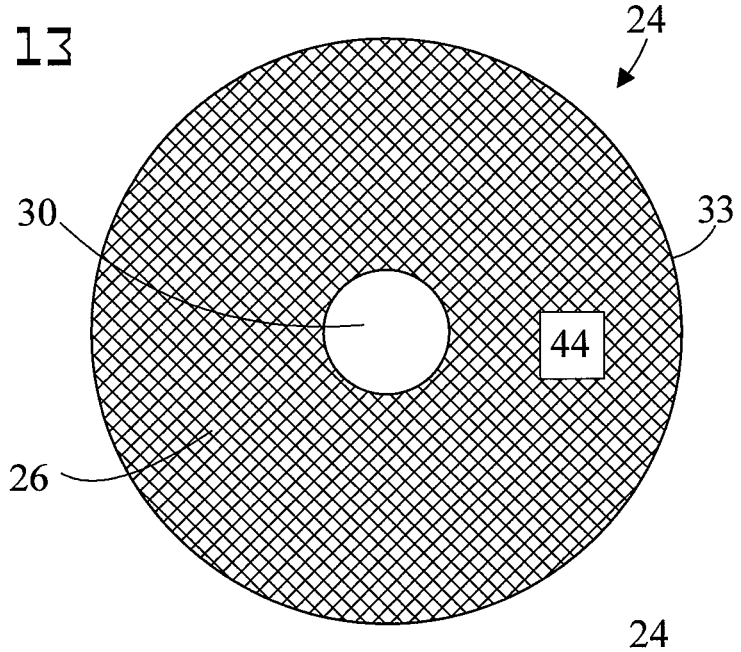
FIG. 13 is a view of the first side of the holder for holding the light emitting diode.
Figure 14:
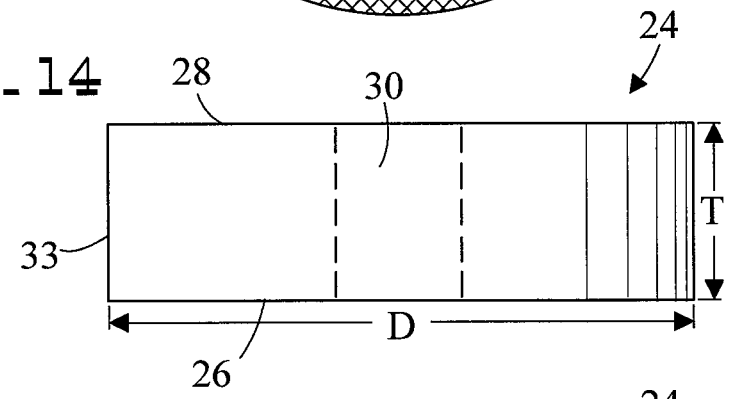
FIG. 14 is an edge view of the holder.
Figure 15:
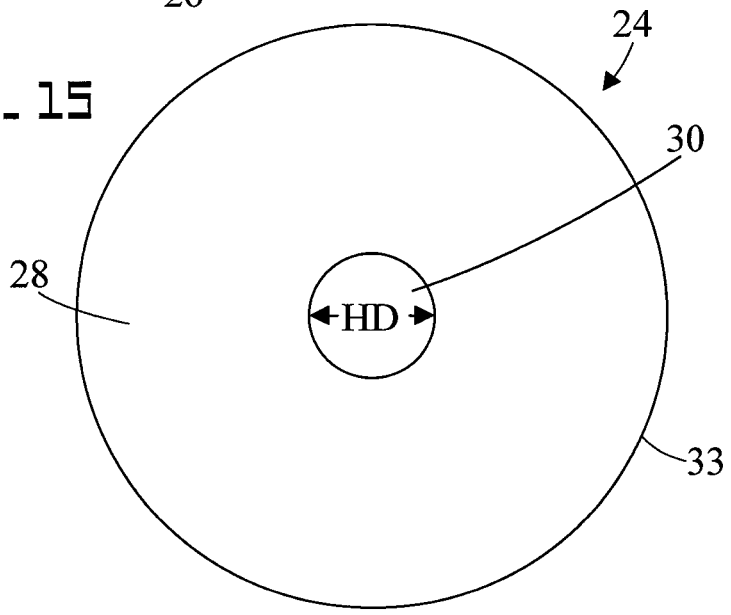
FIG. 15 is a view of the second side of the holder.
Figure 16:
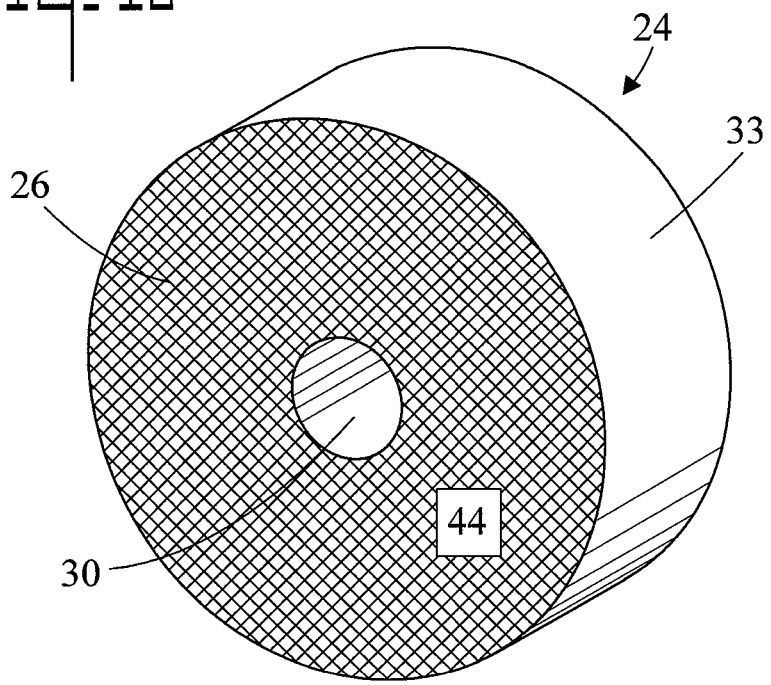
FIG. 16 is a front perspective view of the holder.
Figure 17:
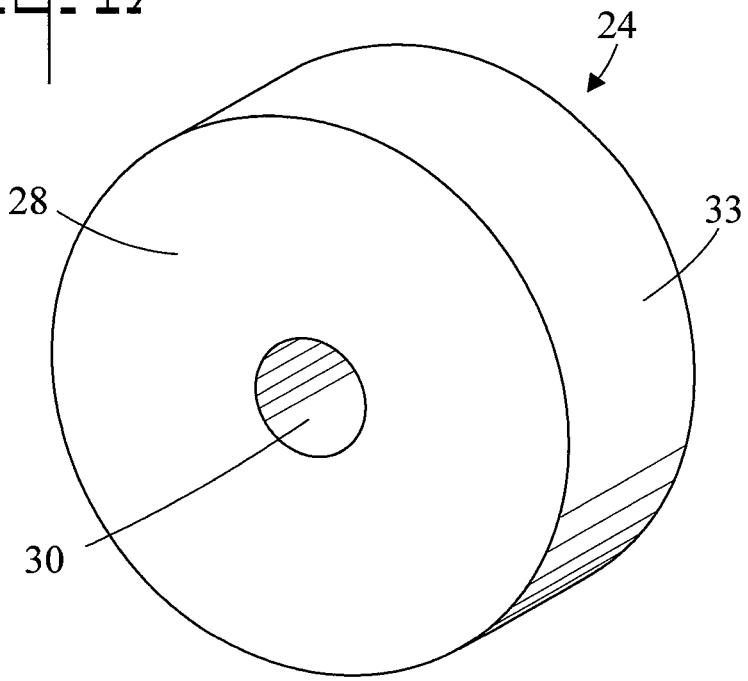
FIG. 17 is a rear perspective view of the holder.

FIGS. 13-17 are first side, edge, second side, front perspective, and rear perspective views respectively of holder 24 which holds light emitting diode 22 (refer to FIGS. 8-12). In the shown embodiment, holder 24 is disc shaped wherein flat first side 26 is parallel to flat second side 28 with a circular edge 33 disposed therebetween. Hole 30, which extends from first side 26 to second side 28), receives light emitting diode 22 (refer to FIGS. 18 and 19). In an embodiment, hole 30 is circular and has a hole diameter HD. In an embodiment, holder 24 is fabricated from resilient foam material. In another embodiment, an adhesive is used to connect holder 24 to the inside surface 502 of balloon 500 (refer to FIG. 4). As shown in FIGS. 13 and 16, an adhesive 44 is disposed on first side 26 of holder 24. In an embodiment, holder 24 has a diameter D of about 9/32 of an inch, and a thickness T of about 5/32 of an inch. In another embodiment, the ratio D/HD is about 4.5.

Figure 18:
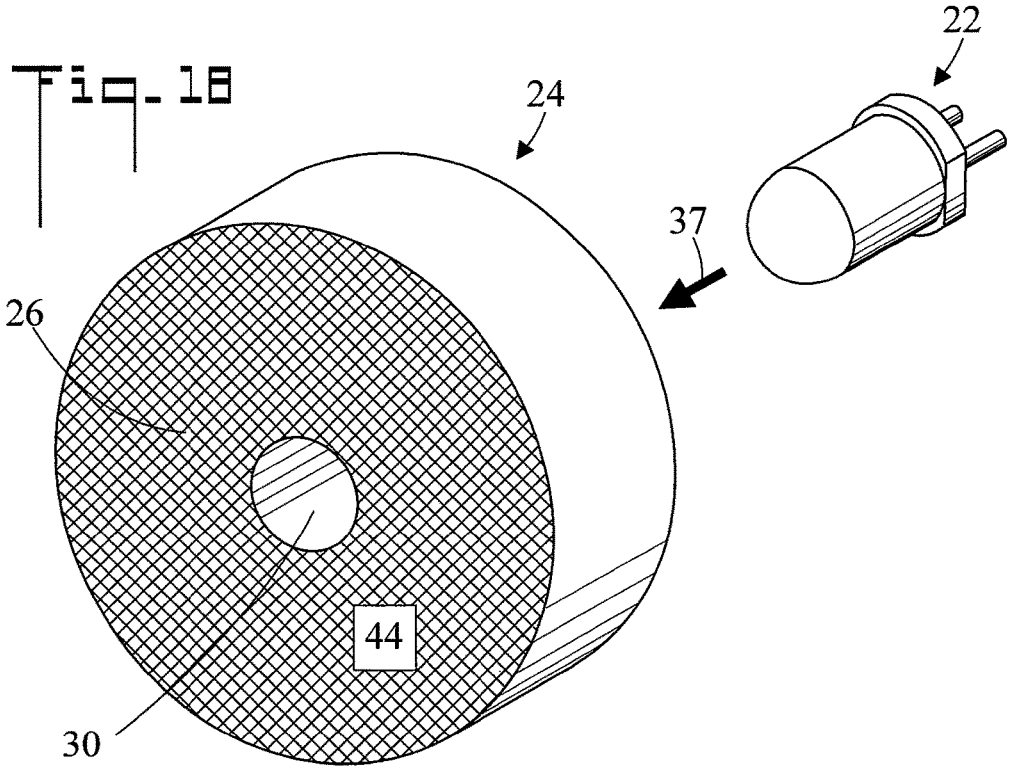
FIG. 18 is a front perspective view of the holder with a light emitting diode being placed in the holder.

FIG. 18 is a front perspective view of holder 24 with a light emitting diode 22 being placed in holder 24. Light emitting diode 22 is inserted into hole 30 in direction 37 from second side 28 (refer to FIG. 17). Light emitting diode 22 can be placed in holder 24 either before of after holder 24 is connected to the inside surface 502 of balloon 500 (refer to FIG. 4).

Figure 19:
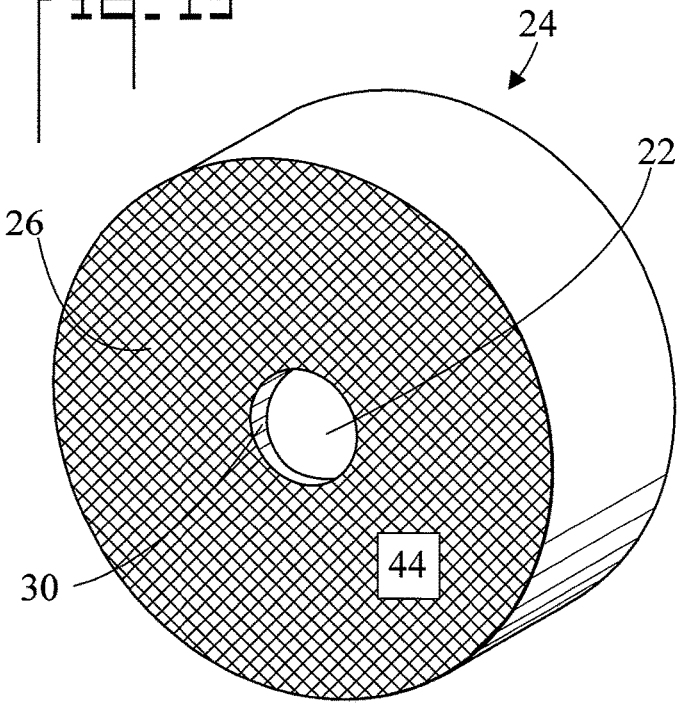
FIG. 19 is a front perspective view of the holder with the light emitting diode placed in the holder.

FIG. 19 is a front perspective view of holder 24 with light emitting diode 22 placed in holder 24. The connection of light emitting diode 22 to holder 24 can be effected in various ways. For example, an adhesive can be used to hold light emitting diode 22 in place in hole 30. Or, hole 30 can be smaller than light emitting diode 22 and a press fit connection utilized.

Figure 20:
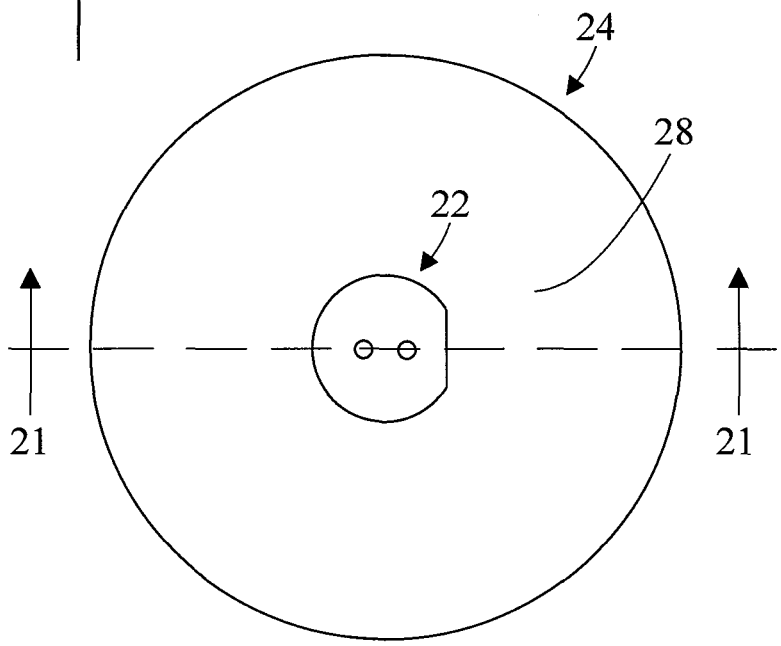
FIG. 20 is a view of the second side of the holder with the light emitting diode placed therein.
Figure 21:
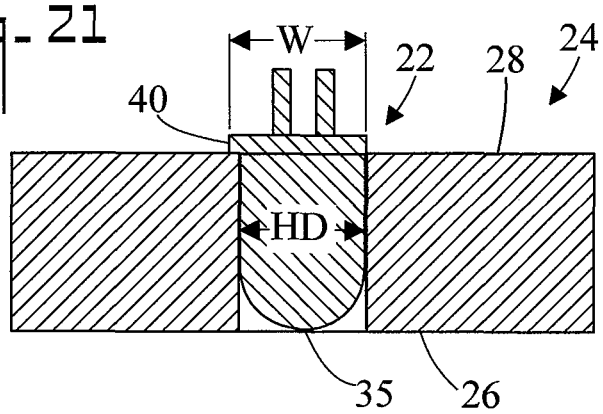
FIG. 21 is a cross sectional view along the line 21-21 of FIG. 20.

FIG. 20 is a view of second side 28 of holder 24 with light emitting diode 22 placed therein, and FIG. 21 is a cross sectional view along the line 21-21 of FIG. 20. In the shown embodiment flange 40 of light emitting diode 22 has a width W. Hole 30 of holder 24 has a hole diameter HD which is less than width W. As such, when light emitting diode 24 is inserted into holder 24 from second side 28, flange 40 abuts second side 28 and resides outside hole 30. In another embodiment, light emitting diode 22 has a tip 35. Tip 35 is the furthest extension of the light emitting end of light emitting diode 22. When light emitting diode 22 is installed in holder 24, tip 35 does not outwardly extend beyond first side 26 of holder 24.

Figure 22:
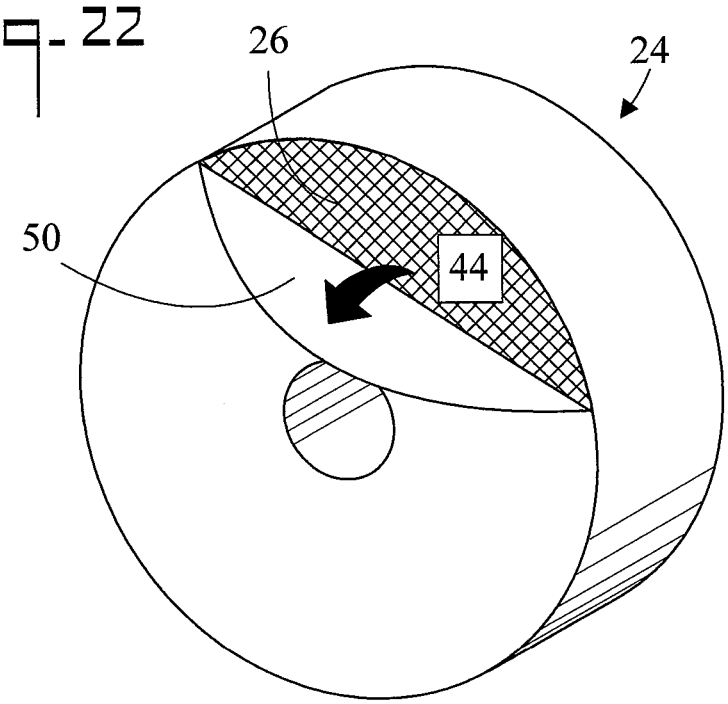
FIG. 22 is a front perspective view of release paper being removed from the first side of the holder.

FIG. 22 is a front perspective view of release paper 50 being removed the first side 26 of holder 24 which contains adhesive 44. Release paper 50 exposes adhesive 44, and is removed just prior to connecting holder 24 to the inside surface 502 of balloon 500 (refer to FIG. 4).

Figure 23:
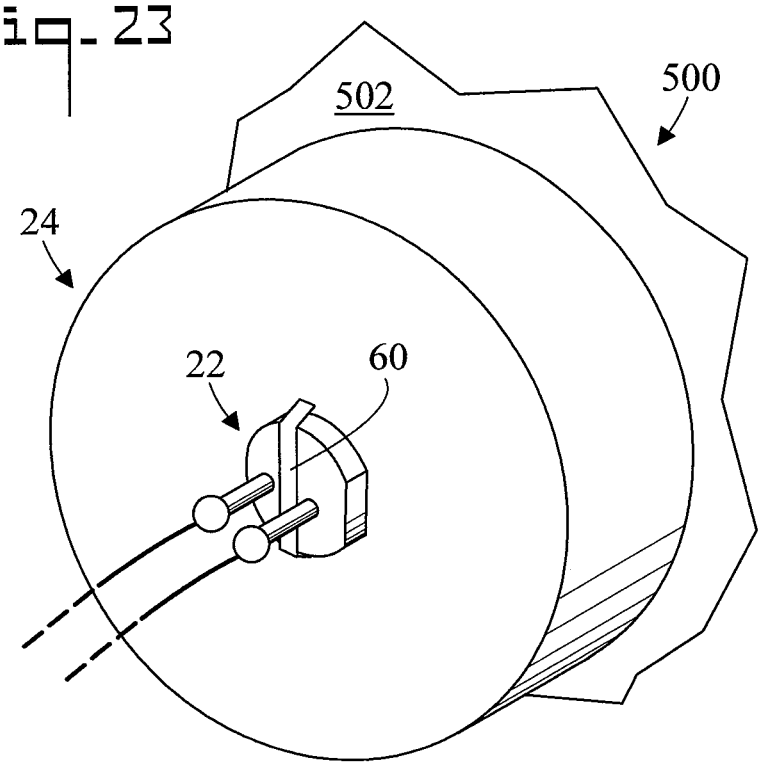
FIG. 23 is a rear perspective view of the holder with a light emitting diode placed therein, and with a strap holding the light emitting diode in place.

FIG. 23 is a rear perspective view of holder 24 with light emitting diode 22 placed therein, and with a strap 60 holding light emitting diode 22 in place.

Figure 24:
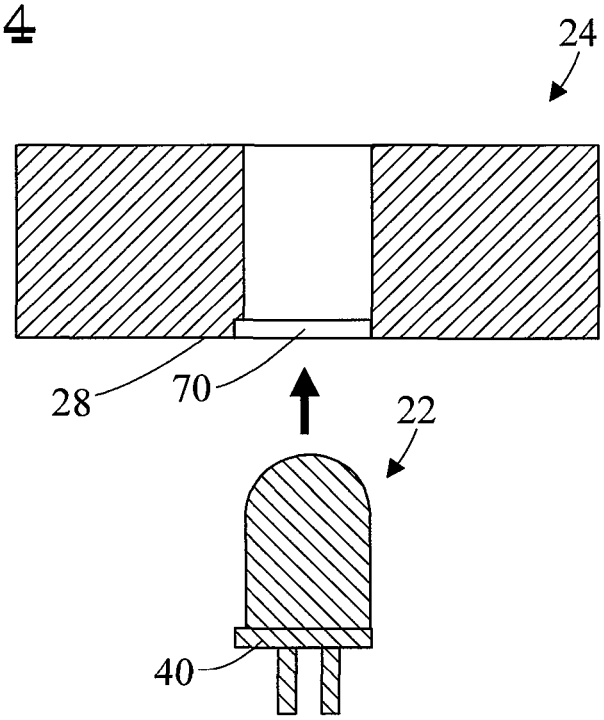
FIG. 24 is a cross sectional view as in FIG. 21 showing a second embodiment of holder; and, FIG. 25 is a rear perspective view of the second embodiment holder.
Figure 25:
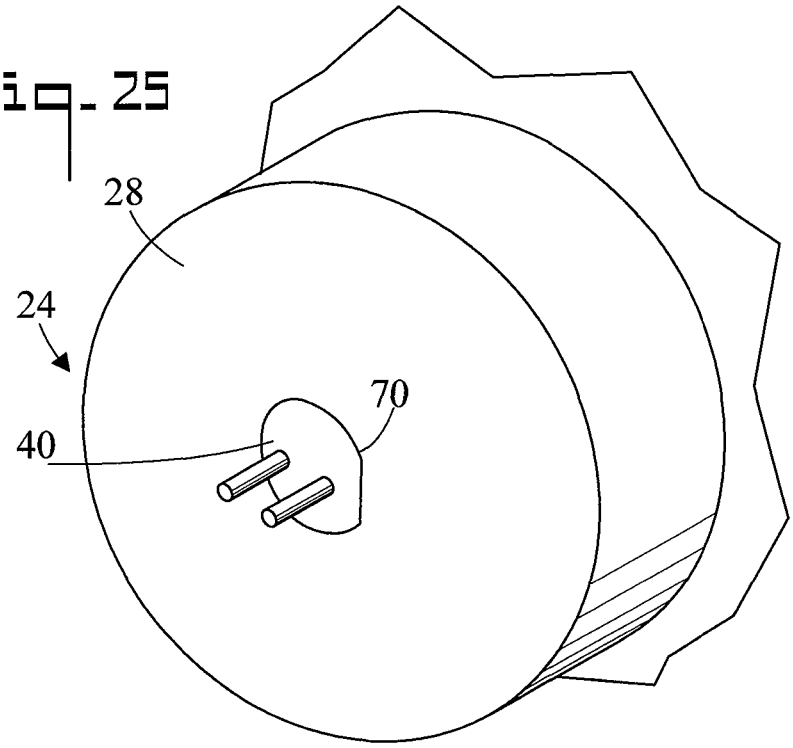

FIG. 24 is a cross sectional view as in FIG. 21 showing a second embodiment of holder 24, and FIG. 25 is a rear perspective view of the second embodiment holder 24. In this embodiment, the second side 28 of holder 24 has a recess 70 which is shaped and dimensioned to closely receive flange 40 of light emitting diode 22, so that when light emitting diode 22 inserted into holder 24 flange 40 is flush with second surface 28 of holder 24.

In another embodiment, device 20 is combined with balloon 500 to form an illuminated balloon.

In terms of use, a method for attaching lights to a balloon 500 includes: (refer to FIGS. 1-25):

(a) providing a balloon 500 having an inside surface 502 and a center 510;

(b) providing a light emitting diode 22 having a lens 38;

(c) providing a holder 24 having a first side 26, an opposite second side 28, and a hole 30 which is shaped and dimensioned to receive light emitting diode 22, hole 30 extending from first side 26 to second side 28;

(d) placing light emitting diode 22 in hole 30 of holder 24; and, (e) connecting first side 26 of holder 24 to inside surface 502 of balloon 500 so that lens 38 directs light 25 outwardly through inside surface 502 of balloon 500 and away from the center 510 of balloon 500.

The method further including:

in (a), balloon 500 having a window 508; and, in (e), holder 24 connected to inside surface 502 of balloon 500 so that light emitting diode 22 is aligned with window 508.

The method further including:

providing an adhesive 44; and, in (e), using adhesive 44 to connect first side 26 of holder 24 to inside surface 502 of balloon 500.

The method further including:

repeating (b) through (e) for a plurality of light emitting diode 22 and holder 24 pairs.

The embodiments of the device and method for an illuminated balloon described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method for an illuminated balloon should be construed as limiting the invention to a particular embodiment or combination of embodiments. The scope of the invention is defined by the appended claims.

I claim:

1. A device for an illuminated balloon having an inside surface and a center, comprising:

a light emitting diode having a lens;

a holder connected to said light emitting diode, said holder having a first side, an opposite second side, and a hole which receives said light emitting diode, said hole extending from said first side to said second side;

said first side of said holder connectable to the inside surface of the balloon so that said lens directs light outwardly through the inside surface of the balloon and away from the center of the balloon;

said light emitting diode having an electrical terminal; and, said electrical terminal disposed closer to the center of the balloon than said lens.

2. The device according to claim 1, further including:

said light emitting diode having a flange; and, said second side of said holder having a recess which is shaped and dimensioned to closely receive said flange of said light emitting diode.

3. The device according to claim 1, further including:

said light emitting diode having a longitudinal axis;

said longitudinal axis being substantially perpendicular to said first side; and, when said holder is connected to the inside surface of the balloon, said longitudinal axis is substantially perpendicular to the inside surface of the balloon.

4. The device according to claim 1, the balloon having a window, the device further including:

said holder connectable to the inside surface of the balloon so that said light emitting diode is aligned with the window.

5. The device according to claim 1, further including:

said holder being disc shaped wherein said first side is parallel to said second side with a circular edge disposed therebetween.

6. The device according to claim 1, further including:

said holder being fabricated from foam.

7. The device according to claim 1, further including:

an adhesive for connecting said first side of said holder to the inside surface of the balloon.

8. The device according to claim 1, further including:

said light emitting diode having a tip; and, said tip of said light emitting diode not outwardly extending beyond said first side of said holder.

9. The device according to claim 1, further including:

said light emitting diode having a flange, said flange having a width W; and, said hole in said holder having a diameter HD, wherein HD is less than W.

10. An illuminated balloon, comprising:

a balloon having an inside surface and a center;

a light emitting diode having a lens;

a holder connected to said light emitting diode, said holder having a first side, an opposite second side, and a hole which receives said light emitting diode, said hole extending from said first side to said second side;

said first side of said holder connected to said inside surface of said balloon so that said lens directs light outwardly through said inside surface of said balloon and away from said center of said balloon;

said light emitting diode having an electrical terminal; and, said electrical terminal disposed closer to said center of said balloon than said lens.

11. The illuminated balloon according to claim 10, further including:

said light emitting diode having a longitudinal axis;

said longitudinal axis being substantially perpendicular to said first side;

said longitudinal axis being substantially perpendicular to said inside surface of said balloon;

said balloon having a window;

said holder connected to said inside surface of said balloon so that said light emitting diode is aligned with said window;

said holder being disc shaped wherein said first side is parallel to said second side with a circular edge disposed therebetween;

said holder being fabricated from foam;

an adhesive connecting said first side of said holder to said inside surface of said:

said light emitting diode having a tip;

said tip of said light emitting diode not outwardly extending beyond said first side of said holder; and, said light emitting diode having a flange, said flange having a width W; and, said hole in said holder having a diameter HD, wherein HD is less than W.

12. The illuminated balloon according to claim 10, further including:

said light emitting diode having a flange; and, said second side of said holder having a recess which is shaped and dimensioned to closely receive said flange of said light emitting diode.

13. The illuminated balloon according to claim 10, further including:

said light emitting diode having a flange, said flange having a width W; and, said hole in said holder having a diameter HD, wherein HD is less than W.

14. The illuminated balloon according to claim 10, further including:

said light emitting diode having a longitudinal axis;

said longitudinal axis being substantially perpendicular to said first side; and, said longitudinal axis being substantially perpendicular to said inside surface of said balloon.

15. The illuminated balloon according to claim 10, further including:

said balloon having a window; and, said holder connected to said inside surface of said balloon so that said light emitting diode is aligned with said window.

16. The illuminated balloon according to claim 10, further including:

said holder being disc shaped wherein said first side is parallel to said second side with a circular edge disposed therebetween.

17. The illuminated balloon according to claim 10, further including:

said holder being fabricated from foam.

18. The illuminated balloon according to claim 10, further including:

an adhesive connecting said first side of said holder to said inside surface of said balloon.

19. The illuminated balloon according to claim 10, further including:

said light emitting diode having a tip; and, said tip of said light emitting diode not outwardly extending beyond said first side of said holder.

* * * * *